United States Patent [19]

Pfaff

[11] 4,309,126

[45] Jan. 5, 1982

[54] MACHINE FOR SEPARATING CONCRETE FROM STEEL

[76] Inventor: Deems M. Pfaff, 6801 W. 150th St., Apple Valley, Minn. 55124

[21] Appl. No.: 140,959

[22] Filed: Apr. 17, 1980

[51] Int. Cl.[3] ..... E01C 23/12

[52] U.S. Cl. ..... 404/90; 241/271; 404/133; 299/37

[58] Field of Search ..... 404/90, 91, 133; 299/37, 52; 241/270, 271, 283, 285 R

[56] References Cited

U.S. PATENT DOCUMENTS

| | | | |
|---|---|---|---|
| 569,573 | 10/1896 | Buchanan | 241/270 X |
| 1,275,742 | 8/1918 | Pritchard | 404/133 |
| 1,715,724 | 6/1929 | Thompson | 241/270 X |
| 1,745,100 | 1/1930 | Johnston | 404/90 X |
| 1,945,322 | 1/1934 | La Fayette | 404/90 X |
| 2,562,899 | 8/1951 | Finn | 404/133 X |
| 2,768,794 | 10/1956 | Rutman | 404/90 X |
| 3,670,971 | 6/1972 | Schneider | 241/271 X |
| 3,732,023 | 5/1973 | Rank | 404/90 |

*Primary Examiner*—Nile C. Byers, Jr.

[57] ABSTRACT

Apparatus for pulverizing concrete sheets such as roadways, and for separating reinforcing steel from concrete, having an anvil for positioning under and in supporting relationship to the concrete, a hammer for repeatedly striking the concrete from above, and a drive mechanism for imparting relative movement between the concrete and the anvil and hammer combination.

17 Claims, 5 Drawing Figures

MACHINE FOR SEPARATING CONCRETE FROM STEEL

BACKGROUND OF THE INVENTION

This invention relates to a machine for pulverizing concrete sheets or slabs, and more particularly to a machine for pulverizing concrete roadbeds having reinforcing steel therein, where the machine is moved along the roadbed during the pulverizing operation.

The replacement of concrete roadways creates a unique and troublesome disposal problem whenever large and bulky concrete slab or sheet structures must be removed from the work site. Such large structures are unsuitable for disposal in landfills unless broken up into small pieces because they tend to create voids underground which prevent adequate filling and compaction. While air and hydraulic hammer machines have been developed to break up such concrete structures into smaller pieces, these machines are particularly unsuitable when the concrete has reinforcing steel embedded therein. Even after hammering, concrete tends to adhere to the steel, resulting in tangled steel and concrete debris which is difficult to move and dispose of. The reinforcing steel itself is usually not reclaimable because of the exceedingly high concrete content which adheres to it. This material is typically trucked to remote disposal sites for inadequate disposition, for no better disposal or recycling program is known for such material. The hauling of this material to remote sites adds to the cost of reconstruction, and the loss of the steel and concrete material for recycling creates a needless economic loss to the owner of the material.

In the reconstruction of roadbeds the old concrete roadbed is typically hammered by means of machines to reduce the size of the concrete and steel fragments to manageable proportions, and these fragments are hauled away. The new roadbed is then filled and graded, and new concrete and reinforcing steel are applied to create a new road. A significant proportion of the total cost of building such a road is attributable to the cost of removing the old roadway, and no significant return is achieved through any recycling process.

U.S. Pat. No. 3,732,023, issued May 8, 1973, discloses a soil stabilization apparatus wherein a machine having a scraper blade cuts beneath an asphalt or asphalt/concrete road by cutting and lifting pieces of the road surface into a pulverizer rotor having cutting and grinding teeth. This apparatus is unsatisfactory for use with concrete roadbeds having reinforced steel imbedded therein, for these roadbeds do not readily break into pieces by lifting, and the reinforcing steel interferes with the operation of the pulverizer rotor.

SUMMARY OF THE INVENTION

The present invention overcomes the disadvantages of the prior art by providing an anvil support structure upon which the concrete is positioned, and by providing one or more hammers to impact the supported concrete. A hammer provides an instantaneous physical impulse to shatter the concrete, and further provide a shock wave through the concrete which, when it reaches the anvil, becomes reflected back through the concrete for further shock wave effect. Since the concrete is supported on, for all practical purposes, an immoveable base, all of the energy imparted by the hammer is usable for creating a physical shock wave for pulverizing the concrete. Further, it has been noted that such a shock wave significantly contributes to the separation of concrete from steel reinforcing rods which may be imbedded therein.

A further aspect of the invention is to provide relative movement between the concrete and the hammer and anvil combination. This relative movement is accomplished by means of a hammer and anvil structure which is moveable by motive power such as tractors. Automatic conveyors may be provided to collect and transport the pulverized concrete material away from the area.

It is a principal object of this invention to provide a machine for separating concrete from steel and for pulverizing the concrete.

It is another object of the present invention to provide a concrete and steel separating machine having a hammer and anvil combination wherein relative motion between such combination and a concrete sheet is accomplished for pulverizing an elongated section of such sheet.

It is a further object of the present invention to provide a concrete and steel separating machine wherein the hammers may be transversely moved relative to the concrete sheet, and where conveying means is provided for transporting pulverized residue from the work site.

BRIEF DESCRIPTION OF THE DRAWINGS

A preferred and alternative embodiment is described herein, and with particular reference to the drawings, in which:

FIG. 1 is an isometric pictorial view of a preferred embodiment of the invention;

DESCRIPTION OF THE PREFERRED EMBODIMENT

Figure 2:
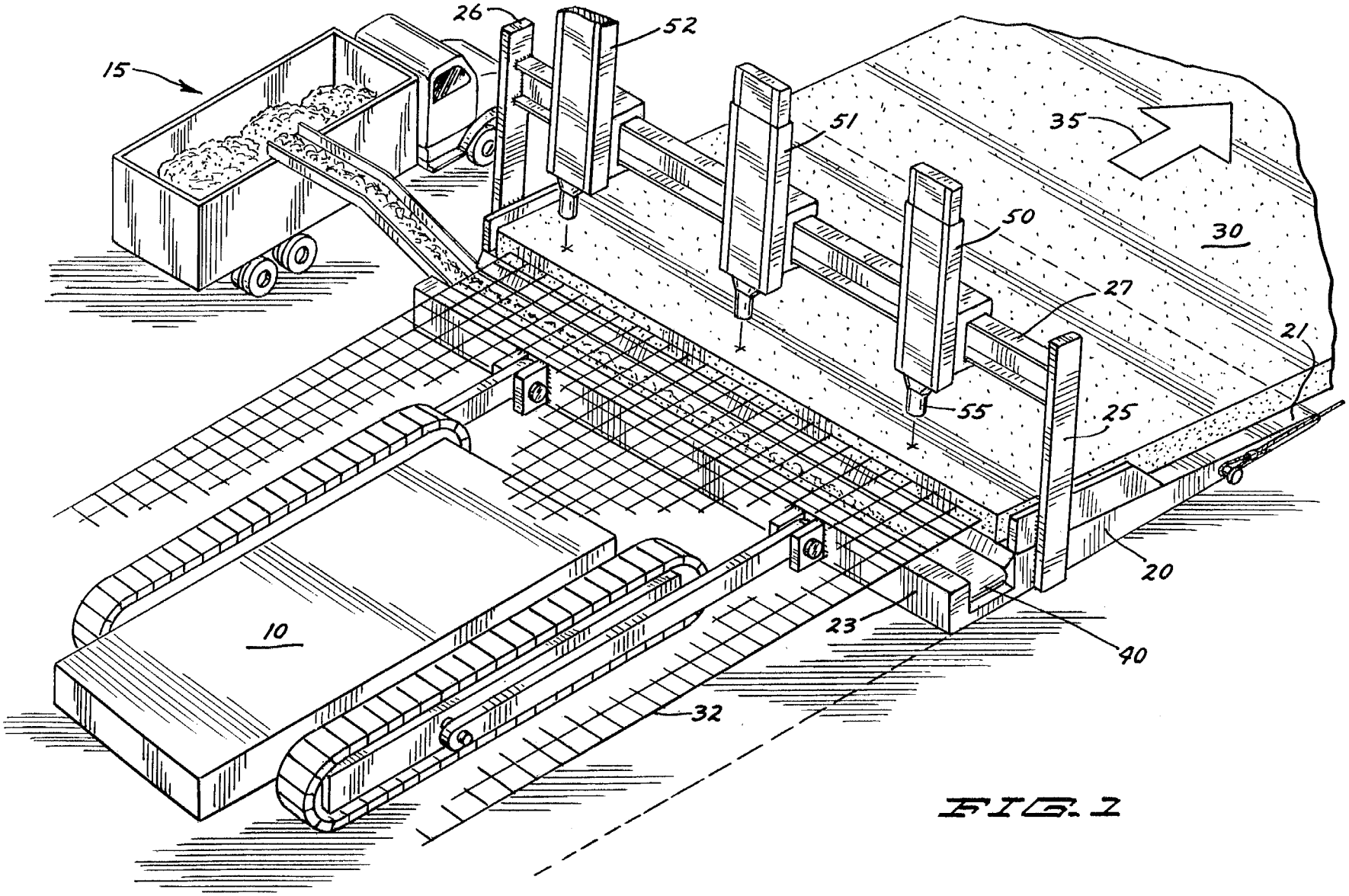
FIG. 2 is a front elevational view of the invention.
Figure 2:
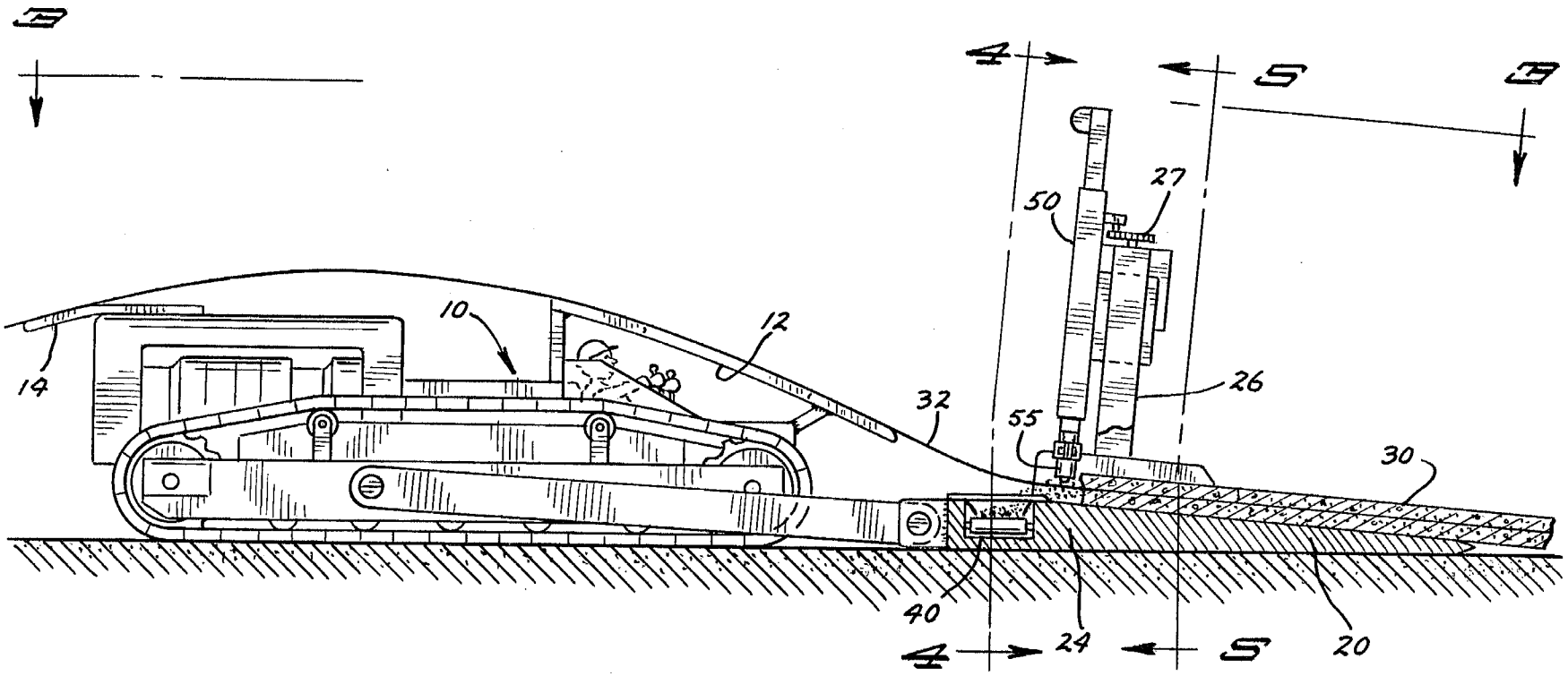

Referring first to FIG. 1, there is shown an isometric view of a preferred embodiment of the invention. A motive power device 10, preferably a track-driven device is coupled to a wedge-shaped skid 20 for moving the skid 20 along the ground. Certain portions of power device 10 have been removed from FIG. 1 for clarity, and are shown in further detail in FIG. 2. Skid 20 is positioned beneath a concrete roadway 30 which is desired to be pulverized and removed. Roadway 30 is comprised of a concrete sheet typically from 6–12 inches in thickness and having embedded therein a structural steel mat 32 which is necessary for structural reinforcement. The forward end 21 of skid 20 is tapered to form the wedge shape, and the rear end 23 of skid 20 is adapted for coupling to motive power device 10. Arrow 35 indicates generally the direction of motive power drive for the apparatus.

A conveyor 40, preferably a belt conveyor, is transversely mounted proximate the rear end of skid 20, and is powered so as to convey residue material leftward toward a collection truck 15 or the like. Conveyor 40 may be independently powered by means of a gasoline engine or other device (not shown) in any of a number of well-known ways.

A pair of vertical beams 25, 26 are attached to the side of skid 20 and an elevated rail 27 is attached therebetween. A plurality of hammer devices 50, 51, 52 are slideably attached on rail 27 by means of an assembly which will be hereinafter described. Each of the hammer devices has a movable hammer, as for example hammer 55 on device 50, which hammer is vertically reciprocable under hydraulic control.

FIG. 2 shows a side elevation view of the apparatus, with a portion of the device shown in cross-sectional view for clarity. Motor power device 10 may be constructed from a diesel powered track-driven tractor such as is manufactured by the Caterpillar Company of Peoria, Illinois. The operator's drive position is protected by a shield 12, which is a steel plate covering the driver's compartment and over which the roadway steel mat 32 may slide. A second shield 14 is attached to power device 10 to further guide steel mat 32 completely over motive power device 10 when the apparatus is in operation.

Skid 20 is positioned beneath roadway 30 and raises a section of roadway 30 to an inclined plane. The portion of skid 20 which is positioned immediately below the hammers operatively serves as an anvil 24 against which all impact forces are directed. The thickness of steel skid 20 is maximum in this region to provide a large mass for reflecting energy impulses received from the hammers.

The angular inclination of skid 20 is approximately 5–10 degrees. Beams 25 and 26 are mounted so as to be perpendicular to the top face of skid 20, and they are therefore inclined from the vertical at the same angle as the angle of inclination of the top surface of skid 20. Hammer devices 50, 51, 52 are mounted perpendicular to the top surface of skid 20, and the hammers are therefore aligned so as to strike the concrete roadway 30 at a normal angle. FIG. 2 illustrates hammer 55 in its lowermost position, which is below the top surface level of the concrete roadway as supported by skid 20.

Figure 3:
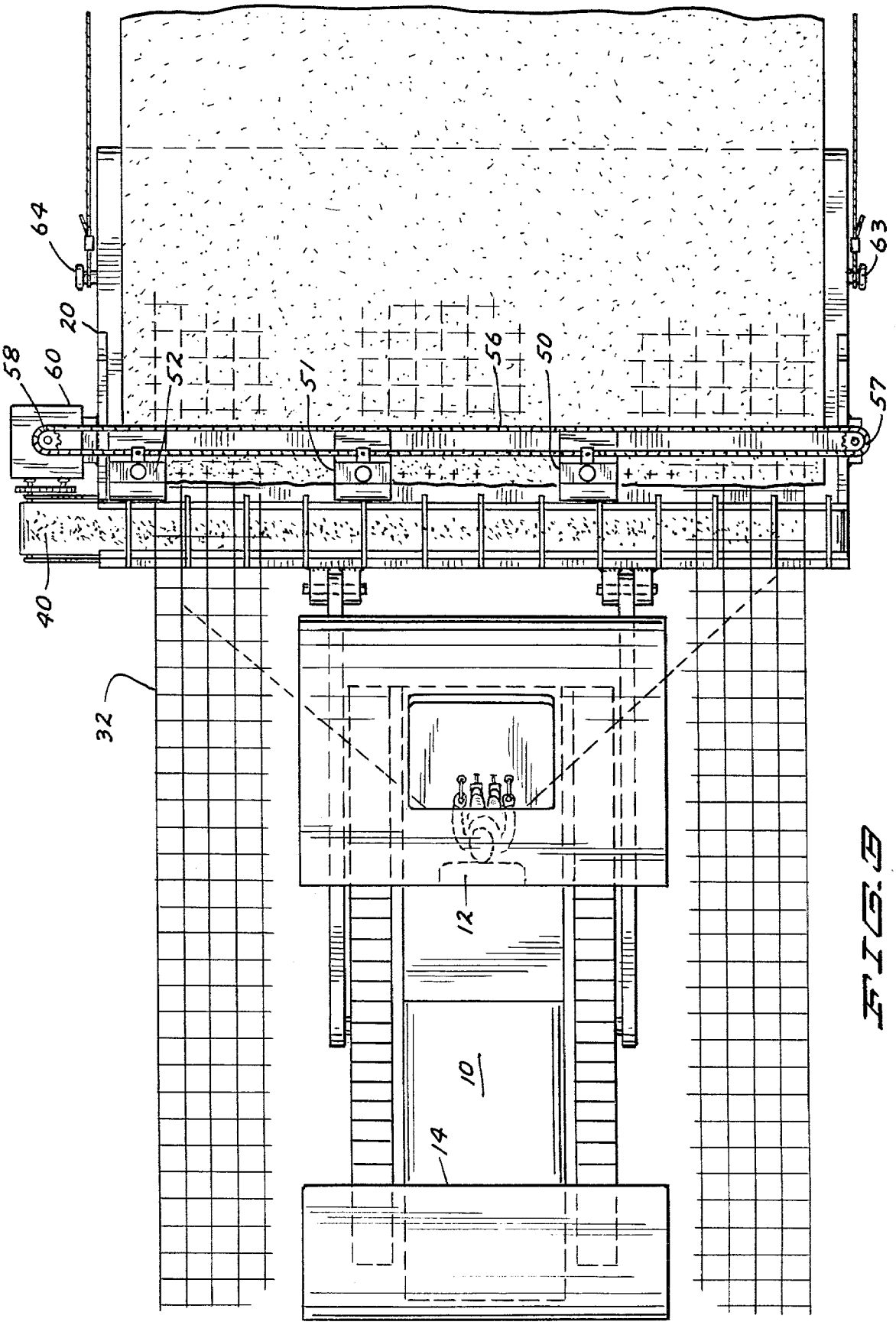
FIG. 3 is a top view of the invention.

FIG. 3 shows a top view of the apparatus with a partial section taken through the lines 3—3 of FIG. 2. Hammer devices 50, 51, 52 are each connected to a common drive cable or chain 56. Drive cable 56 is an endless loop drive which extends around idler pulley 57 and drive pulley 58. Drive pulley 58 is connected to drive power unit 60, which contains an electrically or hydraulically operated motor for turning pulley 58. When the motor in power unit 60 is activated drive pulley 58 rotates, thereby causing hammer devices 50, 51, 52 to slide along rail 27 and transversely to roadway 30. Power unit 60 is designed so as to provide incremental drive steps to the hammer devices, moving the hammer devices a distance of 6–12 inches at each incremental step. Each hammer device is capable of traveling a distance slightly greater than $\frac{1}{3}$ of the width of roadway 30, and the hammer devices are spaced at equal intervals across roadway 30.

Auxiliary posts 63 and 64 are securely attached to skid 20 for the purpose of attaching additional tow cables to the apparatus for movement along the roadway. In certain situations it is necessary to provide additional towing force to the apparatus, and in these situations tractors may be connected by means of cables to posts 63 and 64 to provide supplementary moving force.

Figure 4:
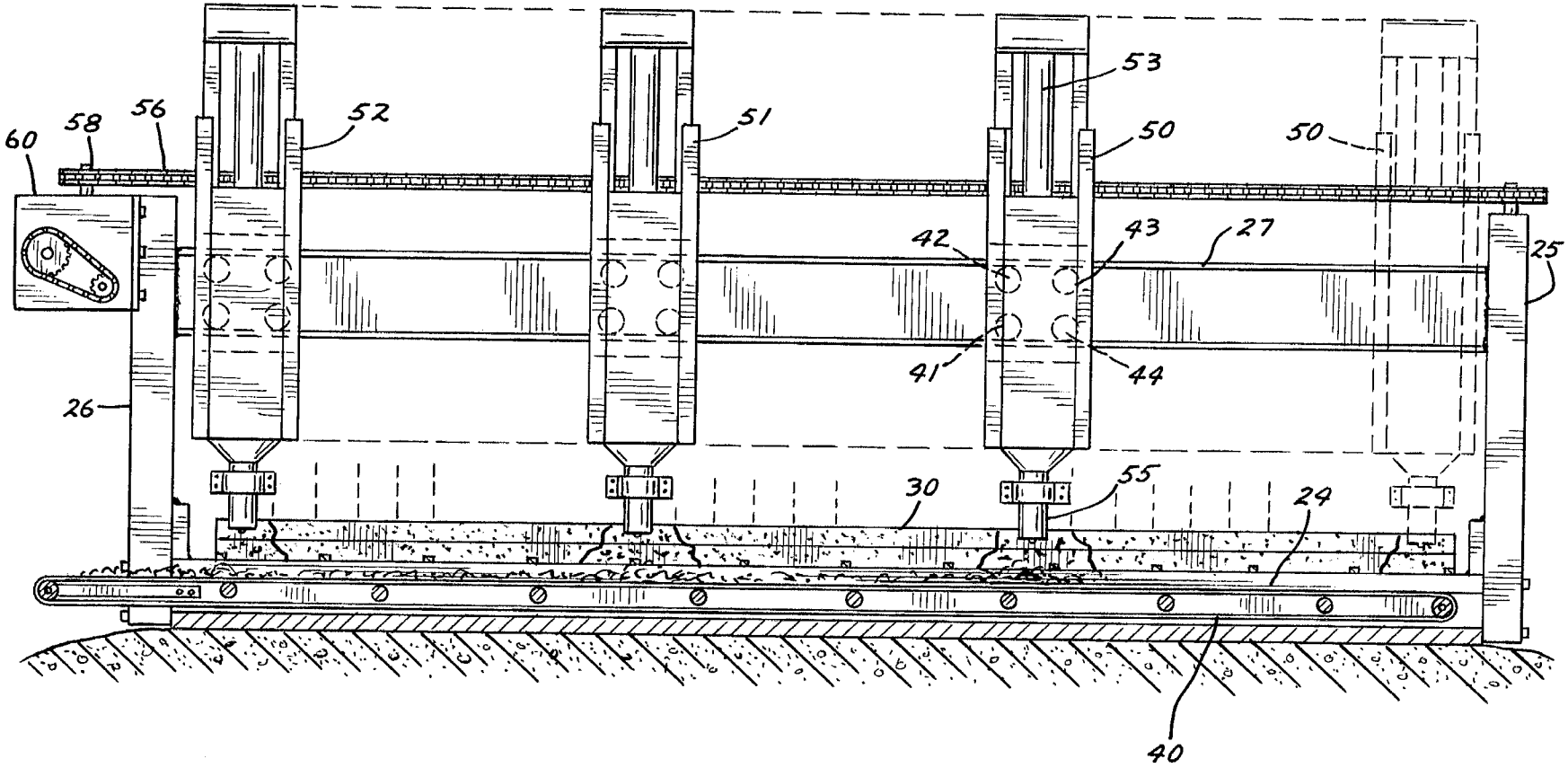
FIG. 4 is a view taken along the lines 4—4 of FIG. 2.

FIG. 4 shows a view taken along the lines 4—4 of FIG. 2. Hammer devices 50, 51, 52 are of identical design, and are identically mounted on rail 27. For example, hammer device 50 is mounted on rail 27, which is in the form of an I beam, by means of rollers 41–44 which bear against respective I beam surfaces. Rollers 41–44, and a set of similar rollers on the inverse side of rail 27, permit hammer device 50 to freely move along rail 27 in a transverse direction relative to roadway 30. The dotted outline illustrates the length of travel of hammer device 50, and the other hammer devices have a similar travel length. Hammer 55, and other identical hammers, is about 8 inches in diameter. The incremental movement of hammer device 50 along rail 27 is selected so that the incremental distance moved is substantially equal to the diameter of hammer 55. Hammer device 50 operates in a reciprocating manner, wherein a hydraulic cylinder 53 raises hammer 55 a predetermined distance and subsequently releases the hammer to impact upon roadway 30. After one or several impact strokes at a given position, hammer device 50 is incrementally moved a distance substantially equal to the hammer diameter, and the hammer stroke reciprocation is repeated. Each of the hammer devices is adapted from a commercially available product, as for example a product known as "super hammer" manufactured by CMI Corporation, Oklahoma City, Oklahoma. The characteristics of such hammers are that they have a variable impact force and a variable stroke rate. The downward stroke is hydraulically assisted, and the energy per blow can be varied from 80 foot-pounds per blow up to 16,000 foot-pounds per blow. The stroke rate is inversely related to the impact force selected for the device, so that at the full impact force of 16,000 foot-pounds per blow, the stroke rate may be 50 blows per minute. As the impact force is reduced the stroke rate may be increased up to a maximum of about 110,000 strokes per minute. This provides a wide range of choices for various roadway constructions, and control over hammer characteristics may be made by the operator while the apparatus is in use.

Figure 5:
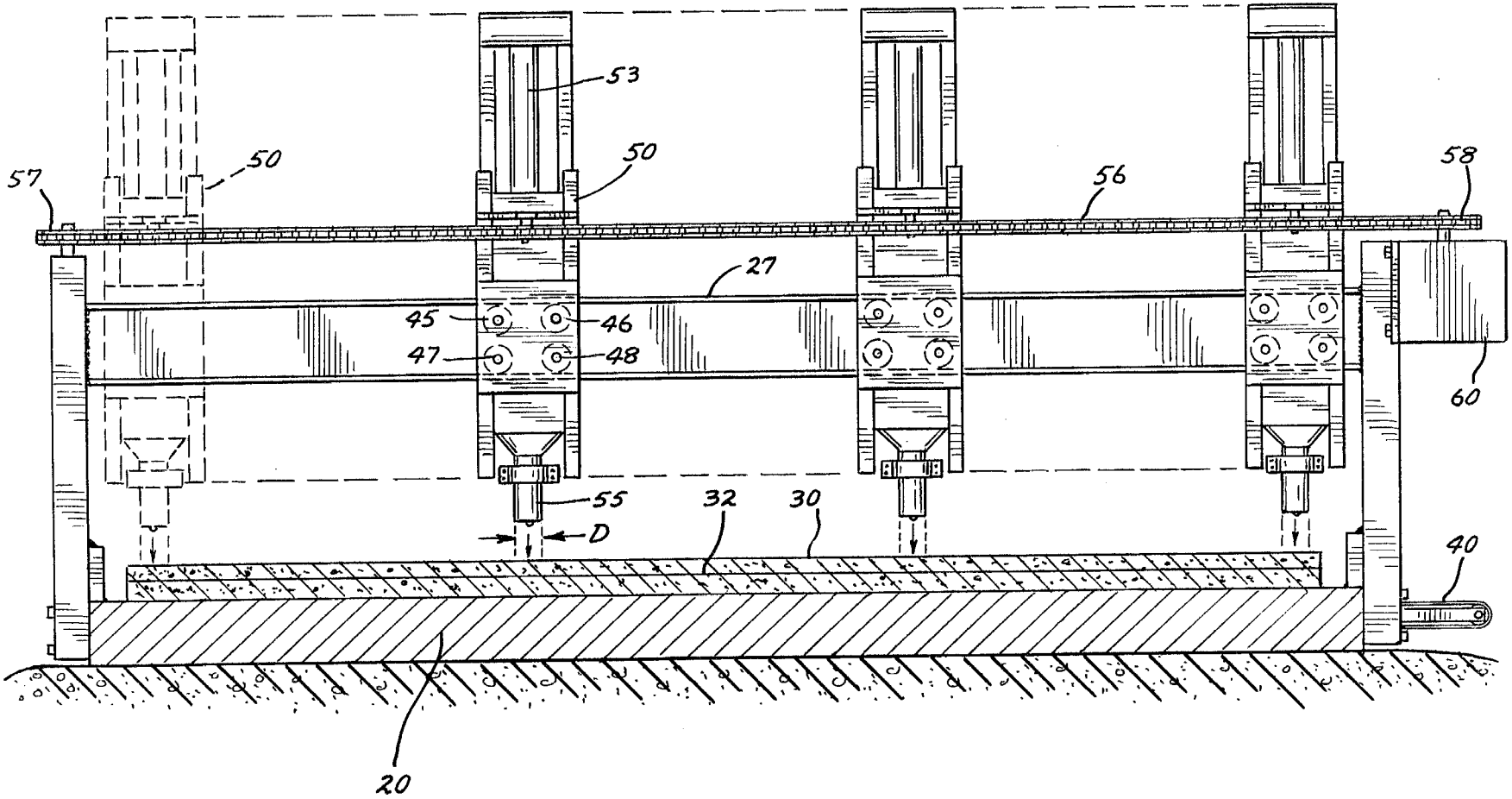
FIG. 5 is a view taken along the lines 5—5 of FIG. 2.

FIG. 5 illustrates a view taken along the lines 5—5 of FIG. 2. Each of the hammer devices has a further set of rollers for guiding it along rail 27,as for example rollers 45–48 for hammer device 50. The incremental drive movement of power unit 60 via drive chain 56 is substantially equal to the diameter D of each of the hammers, as for example hammer 55. At each incremental position the hammer may reciprocate one or a plurality of times, each time imparting an impulse energy force into roadway 30 in the region surrounding the impact point. This impulse force creates a downwardly directed shock wave which shatters the concrete as it travels through roadway 30. When such shock wave reaches the region of skid 20 which is denoted as anvil 24, the heavy mass of anvil 24 causes a reflected shock wave to travel upwardly to further shatter the concrete in roadway 30. It has been found that this combination of forces acts to efficiently separate the concrete fragments from the reinforcing steel mat which is normally imbedded in roadway 30.

In operation, the apparatus is positioned adjacent the end of a roadway to be removed, and the roadway end is raised by means of hydraulic jacks or other devices sufficiently to slide skid 20 underneath the roadway 30 and the roadbed. The apparatus is then slowly powered forward until the hammer devices are positioned at the edge of the roadway. The hammer devices are then simultaneously activated to begin reciprocable hammering, and drive unit 60 is engaged to incrementally guide the hammer devices transversely across roadway 30. Hammer reciprocation is continued at each incremental transverse position of their hammer devices until a full pass has been made of the width of roadway 30. Motive power device 10 is then moved forward a distance approximately equal to D, and the cycle is repeated. As the fragments of concrete break away from the edge of the roadway under impact by the hammers, these fragments fall onto conveyor 40 and are conveyed off to the side of the roadway for removal. As the apparatus progresses down the roadway skid 20 continually wedges the roadway away from the roadbed, and the steel reinforcing mat 32 slides along and over motor power device 10. Steel mat 32 is guided in this travel by means of the shields 12 and 14 mounted on motor power device 10.

After the apparatus has removed a section of roadway in the manner described above, the steel reinforcing mat may be disassembled and removed for reprocessing, or in some instances may be reused as a new roadway is laid over the old roadbed. The concrete fragments removed by conveyor 40 may be also reprocessed in the formation of a new roadway, or may be all the way to a landfill as fill material.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for pulverizing concrete and like material, comprising (a) anvil means for positioning under and in supporting relationship to said concrete;

(b) hammer means for repeatedly striking said concrete from above, said hammer means being positioned over said concrete and said anvil means; and (c) means for forcing movement of said hammer and anvil means relative to said concrete.

2. The apparatus of claim 1, further comprising a frame assembly attached to said anvil means and upon which said hammer means is attached.

3. The apparatus of claim 2 wherein said hammer means further comprises at least one vertically actuated hammer, movably attached to said frame assembly.

4. The apparatus of claim 1, wherein said means for forcing movement further comprises a motive power device coupled to said anvil means.

5. The apparatus of claim 4, wherein said motive power drive further comprises a track-driven vehicle.

6. The apparatus of claim 1, wherein said anvil means further comprises a wedge-shape structure for sliding under said concrete.

7. The apparatus of claim 6, wherein said wedge-shape structure further comprises a steel wedge having a width dimension at least equal to the width of said concrete.

8. The apparatus of claim 6, further comprising an endless conveyor attached to said wedge-shaped structure proximate and parallel to an edge of said concrete.

9. The apparatus of claim 8, further comprising a frame assembly attached to said wedge-shaped structure, and including a member bridging said concrete in spaced apart relation.

10. The apparatus of claim 9, further comprising at least one movable carriage attached to said bridging member.

11. The apparatus of claim 10, wherein said hammer means further comprises a hydraulically-actuated hammer attached to said carriage.

12. The apparatus of claim 11, further comprising power drive means attached to said frame assembly and in drive coupling arrangement to said carriage.

13. The apparatus of claim 12, further comprising guide means attached to said wedge-shaped structure for guiding relative movement of said structure and said concrete.

14. The apparatus of claim 13, wherein said means for forcing relative movement further comprises a track-driven vehicle.

15. The apparatus of claim 14, wherein said track-driven vehicle further comprises a shield attached over the top of said vehicle.

16. The apparatus of claim 15, further comprising means for towing attached to said wedge-shaped structure.

17. An apparatus for pulverizing concrete on roadways, and for separating same from reinforcing steel embedded therein, comprising (a) a movable wedge-shape structure for urging beneath said concrete;

(b) a frame assembly attached to said wedge-shape structure and having a transverse beam bridging said concrete;

(c) at least one movable carriage carried by said beam, and having a reciprocable hammer attached thereto;

(d) means for moving said carriage along said beam to a plurality of positions over said concrete;

(e) motive power means attached to said wedge-shape structure for sliding said structure under said concrete and along said roadway; and (f) means for reciprocating said hammer against said concrete while said concrete is supported on said wedge-shape structure.

* * * * *